US009708750B2

(12) United States Patent
Höfler et al.

(10) Patent No.: US 9,708,750 B2
(45) Date of Patent: Jul. 18, 2017

(54) VENTED LAUNDRY DRYING HAVING AN ADDITIONAL HEATER AND HEAT EXCHANGER UNIT

(75) Inventors: Frank Höfler, Pamplona (ES); Uwe-Jens Krausch, Brieselang (DE); Günter Steffens, Dallgow-Döberitz (DE); Andreas Stolze, Falkensee (DE)

(73) Assignee: BSH Hausgeräte GmbH, Munich (DE)

( * ) Notice: Subject to any disclaimer, the term of this patent is extended or adjusted under 35 U.S.C. 154(b) by 695 days.

(21) Appl. No.: 14/232,362

(22) PCT Filed: Jun. 26, 2012

(86) PCT No.: PCT/EP2012/062280

§ 371 (c)(1),
(2), (4) Date: Feb. 20, 2014

(87) PCT Pub. No.: WO2013/007506

PCT Pub. Date: Jan. 17, 2013

(65) Prior Publication Data

US 2014/0165420 A1 Jun. 19, 2014

(30) Foreign Application Priority Data

Jul. 11, 2011 (DE) ..... 10 2011 078 922

(51) Int. Cl.
*D06F 58/20* (2006.01)

(52) U.S. Cl.
CPC ..... *D06F 58/20* (2013.01); *D06F 58/206* (2013.01)

(58) Field of Classification Search
CPC ..... D06F 58/20; D06F 58/206
See application file for complete search history.

(56) References Cited

U.S. PATENT DOCUMENTS

2006/0179676 A1* 8/2006 Goldberg ..... D06F 25/00 34/77
2007/0107255 A1 5/2007 Tamura et al.
2009/0139107 A1* 6/2009 Grunert ..... D06F 58/206 34/86

FOREIGN PATENT DOCUMENTS

EP 2 189 568 5/2010
JP 2010033508 A * 2/2010
(Continued)

OTHER PUBLICATIONS

International Search Report issued for PCT/EP2012/062280, mailed Nov. 29, 2012.

(Continued)

*Primary Examiner* — Jiping Lu
(74) *Attorney, Agent, or Firm* — Nixon & Vanderhye P.C.

(57) ABSTRACT

A vented laundry dryer has an air inlet duct, an air outlet duct, a heat recovery system for transferring heat from the air outlet duct to the air inlet duct, and an additional heater. The heat recovery system has an evaporator, a liquefier, a condenser, and a relaxation unit, wherein the liquefier is thermally coupled to the air inlet duct, and the evaporator is thermally coupled to the air outlet duct. A relaxation property of the relaxation unit can be adjusted depending on at least one parameter that is connected to an activity of the additional heater. A method for operating a vented dryer having an additional heater and a heat pump having a relaxation unit, monitoring at least one parameter connected to an activity of the additional heater and changing a relaxation property of the relaxation unit depending on the at least one parameter.

18 Claims, 4 Drawing Sheets

(56) References Cited

FOREIGN PATENT DOCUMENTS

WO WO 8204142 A1 * 11/1982 ..... F25B 41/062
WO WO 2011/072999 6/2011

OTHER PUBLICATIONS

Foreign-language Written Opinion of the International Searching Authority for PCT/EP2012/062280, mailed Nov. 29, 2012.

* cited by examiner

VENTED LAUNDRY DRYING HAVING AN ADDITIONAL HEATER AND HEAT EXCHANGER UNIT

This application is the U.S. national phase of International Application No. PCT/EP2012/062280, filed 26 Jun. 2012, which designated the U.S. and claims priority to DE Application No. 10 2011 078 922.7, filed 11 Jul. 2011, the entire contents of each of which are hereby incorporated by reference.

The invention relates to a vented laundry dryer having an air inlet duct, which passes from the outside to a heatable laundry treatment compartment, an air outlet duct, which passes from the laundry treatment compartment to the outside, a heat recovery system for transferring heat from the air outlet duct to the air inlet duct and an additional heater disposed on the air inlet duct. The invention further relates to a method for operating such a vented laundry dryer.

A vented laundry dryer of the type mentioned in the introduction is known for example from DE 197 37 075 A1, wherein the heat recovery system is an air/air heat exchanger, through which both air from the air inlet duct and air from the air outlet duct flow. The air/air heat exchanger here is disposed upstream of an additional heater for flow purposes.

DE 10 2007 062 776 A1 discloses a vented dryer with a drying chamber, a process air duct, in which a heater for heating the process air is located and the heated process air can be passed by means of a fan into the drying chamber, a motor and a controller, said dryer being set up to operate while receiving an electric power that never exceeds a predetermined value Pmax. The vented dryer has means which are set up in such a manner that during operation the dryer receives the electric power according to the predetermined value Pmax at least in phases. The dryer can have a heat pump circuit with an evaporator, a condenser, a compressor and an expansion valve or throttle valve.

Exchanging the air/air heat exchanger for a heat pump can further improve the efficiency of the vented laundry dryer. Efficiency here is a function of a predefined design or tuning of the heat pump, whereby the efficiency increases the more effectively the heat pump is adjusted for a temperature or a temperature difference in the process air and therefore the air ducts. Conversely efficiency is reduced if fluctuations occur in the operating response of the vented laundry dryer, in particular in its temperature or temperature differences. Such fluctuations can occur for example as a function of a load and moisture in the laundry present in the laundry treatment compartment as well as due to operation of the additional heater. An additional heat input generated by the additional heater in particular can cause the evaporator to overheat so much that efficiency is reduced.

The object of the present invention is to provide a possibility for vented laundry drying with a heater (referred to as the "additional heater" in the following) and a heat exchanger unit, which at least partially overcomes the disadvantages of the prior art and in particular can maintain a high level of efficiency over a wider range of operating conditions, in particular temperature changes.

The object is therefore achieved by a vented laundry dryer, having an air inlet duct, which passes from the outside to a heatable laundry treatment compartment, an air outlet duct, which passes from the laundry treatment compartment to the outside, a heat recovery system for transferring heat from the air outlet duct to the air inlet duct and an additional heater disposed on the air inlet duct. The heat recovery system is a heat pump with an evaporator, a condenser, a compressor and a relaxation unit, the condenser being thermally coupled to the air inlet duct and the evaporator being thermally coupled to the air outlet duct. A relaxation property of the relaxation unit can be set as a function of at least one parameter associated with an activity of the additional heater.

Because the evaporator is thermally coupled to the air outlet duct, heat is extracted from the air outlet duct or the hot moist process air (exhaust air) present in the air outlet duct and transferred to the evaporator. Conversely, because the condenser is thermally coupled to the air inlet duct, heat can be transferred from the condenser to the air inlet duct or to the process air (fresh air) present in the air inlet duct. The temperatures or temperature differences (and similarly the pressures or pressure differences) at the evaporator and condenser allow the heat pump circuit to operate. The efficiency of the heat pump is a function of these temperatures or temperature differences and can be optimized by designing the elements of the heat pump for the temperatures or temperature differences for predetermined basic conditions. Changing the relaxation property as a function of the activity of the additional heater allows the heat pump, in particular its optimum operating point, to be adjusted in a simple manner for a particularly significant displacement of the operating point of the heat pump due to the additional heater.

The vented laundry dryer can be a vented washer dryer or a simple vented laundry drying appliance.

The laundry treatment compartment can be in particular a rotatable laundry drum. The vented laundry dryer can be a front loader in particular.

The additional heater can be for example an electrically operated or gas operated additional heater.

The additional heater can be an autonomously operatable additional heater, e.g. operated by solar cells, to reduce energy consumption further.

A parameter associated with an activity of the additional heater can be in particular an operating parameter of the additional heater. In one embodiment therefore the relaxation property of the relaxation unit can be set as a function of at least one operating parameter of the additional heater. Adjustment based on the operation of the additional heater can therefore take place without delay.

In one preferred embodiment the relaxation property of the relaxation unit can be set as a function of a current heating power of the additional heater. The parameter associated with the activity of the additional heater is therefore the heating power. This heating power can therefore be considered in particular as an operating parameter of the additional heater. The heating power can be represented for example by an electric power consumed currently by the additional heater, which can be measured for example by means of a current sensor. Alternatively the heating power can be represented by a setpoint power of the additional heater, meaning there is no need for a current sensor. A relationship between the heating power and the relaxation property, e.g. the flow cross section required for optimized efficiency, can be determined for example by experiment.

In a further preferred embodiment the relaxation property of the relaxation unit can be set as a function of an activation state of the additional heater. The parameter associated with the activity of the additional heater is therefore the activation state ("on" or "off" or the like) of the additional heater. The activation state can therefore also be considered as an operating parameter of the additional heater. It is therefore possible to improve efficiency with particularly simple means. In particular the relaxation unit can thus be switched between a first operating position, which corresponds to a deactivated additional heater, and a second operating position, which corresponds to an activated additional heater. For example a flow cross section can be switched between a smallest flow cross section in the case of a deactivated additional heater and a greatest flow cross section in the case of an activated additional heater. The relaxation unit in particular only needs to have these two operating positions.

In one preferred embodiment the relaxation unit is an expansion valve (also referred to as a throttle valve) and a flow cross section of the expansion valve (as a variable influencing the relaxation property) can be set as a function of the at least one parameter. The heat pump can thus be adjusted in a particularly simple and economical manner. The expansion valve can in particular be a remote-controlled, in particular regulatable, expansion valve. The expansion valve can in particular be an electronic expansion valve. To operate the heat pump the flow cross section of the settable expansion valve may in particular be able to be set between a smallest flow cross section and a greatest flow cross section, both flow cross sections being greater than zero, the expansion valve therefore not being closed even for the smallest flow cross section.

In a further preferred embodiment the relaxation unit has a group of several capillaries connected fluidically in a parallel manner, of which at least one capillary can be opened and closed optionally as a function of the at least one parameter. A flow cross section of the relaxation unit is therefore then determined by the number of open capillaries, with the result that the relaxation unit then has a flow cross section that can be set in stages. A capillary can in particular be present in the form of an expansion valve with a fixed flow cross section in the open state. In particular all the capillaries or all the capillaries apart from a first capillary can be opened and closed optionally.

In a further preferred embodiment the relaxation unit can be set in such a manner that it can (only) be switched between a first operating position and a second operating position. In this case the relaxation unit therefore has in particular only two settable flow cross sections. Such a relaxation unit may be able to be embodied in a particularly simple and economical manner, e.g. by providing just two capillaries.

In another preferred embodiment the relaxation unit can be set in multiple stages or continuously, allowing even more accurate adjustment of the heat pump. For example the expansion valve can change its flow cross section in stages or continuously. To operate the heat pump the flow cross section of the settable expansion valve may be able to be set in particular in steps or stages between a smallest flow cross section and a greatest flow cross section. A total flow cross section of the group of several capillaries connected fluidically in a parallel manner can also be set simply in stages or multiple stages.

In a further preferred embodiment the relaxation property, in particular the flow cross section, of the relaxation unit can be set as a function of a temperature difference and/or a pressure difference. The at least one parameter associated with the activity of the additional heater therefore comprises a temperature difference and/or a pressure difference. The temperature difference and/or a pressure difference can be a difference in the air duct or the process air. The temperature difference and/or the pressure difference can alternatively or additionally be a difference in the cooling circuit or the coolant. This embodiment allows particularly accurate adjustment of the heat pump.

It is particularly preferable for the relaxation unit to be able to be set as a function of a temperature difference and/or a pressure difference at the evaporator (i.e. between an entry temperature and an exit temperature of the coolant at the evaporator).

The setting of the relaxation property, in particular the flow cross section, as a function of the current heating power, temperature difference, pressure difference and/or another parameter of the vented laundry dryer, which can assume a number of values, may be set in proportion (in other words in linear proportion or non-linear proportion) to said parameter, optionally just within a predefined value range of the parameter.

Setting can alternatively or additionally be performed on reaching or rising above and/or dropping below one or more threshold values of at least one parameter of the vented laundry dryer. Thus a settable expansion valve may be opened or closed in stages, if corresponding threshold values for heating power and/or temperature difference are reached at the evaporator.

The object is also achieved by a method for operating a vented laundry dryer with an additional heater and a compression heat pump with a relaxation unit, the method having at least the following steps: (a) monitoring at least one parameter associated with an activity of the additional heater (e.g. a power of the additional heater and/or a temperature difference at an evaporator) and (b) changing a relaxation property of the relaxation unit as a function of the at least one parameter. The method has the same advantages as the described vented laundry dryer and can be embodied in a similar manner.

Monitoring can in particular comprise ascertaining a setpoint value and/or measuring an actual value.

For example the relaxation unit can be a settable expansion valve and the method can have at least the following steps: (a) monitoring an activation state (on/off) of the additional heater and (b) widening a flow diameter of the expansion valve with an additional heater connected and narrowing the flow diameter of the expansion valve with an additional heater deactivated.

In the context of a further example the relaxation unit can be an expansion valve and the method can have at least the following steps: (a) monitoring a temperature difference and/or a pressure difference (in particular of the coolant, in particular between an entry temperature and an exit temperature of the coolant at the evaporator; (b) widening a flow diameter of the expansion valve as the temperature difference and/or pressure difference rises and (c) reducing the flow diameter of the expansion valve as the temperature difference and/or pressure difference drops. Widening and reducing can be performed continuously or in stages (in particular by means of threshold values).

In the context of yet a further example the relaxation unit can have a group of capillaries connected fluidically in a parallel manner, of which at least one capillary can be opened and closed optionally as a function of the at least one parameter, and the method has at least the following steps: (a) monitoring a heating power of the additional heater and (b) opening at least one previously closed capillary as the heating power rises and (c) closing at least one previously opened capillary as the heating power drops.

In the context of yet another example the relaxation unit can be a group of capillaries connected fluidically in a parallel manner, of which at least one capillary can be opened and closed optionally as a function of the at least one parameter, and the method has the following steps: (a) monitoring a temperature difference and/or a pressure difference (in particular of the coolant, in particular between an entry temperature and an exit temperature of the coolant at the evaporator) and (b) opening at least one previously closed capillary as the temperature difference and/or pressure difference rises and (c) closing at least one previously opened capillary as the temperature difference and/or pressure difference drops. Widening and reducing are therefore performed in stages.

The invention is described schematically in more detail based on exemplary embodiments in the figures below. Identical elements or those with the same effect can be shown with identical reference characters for greater clarity.

Figure 1:
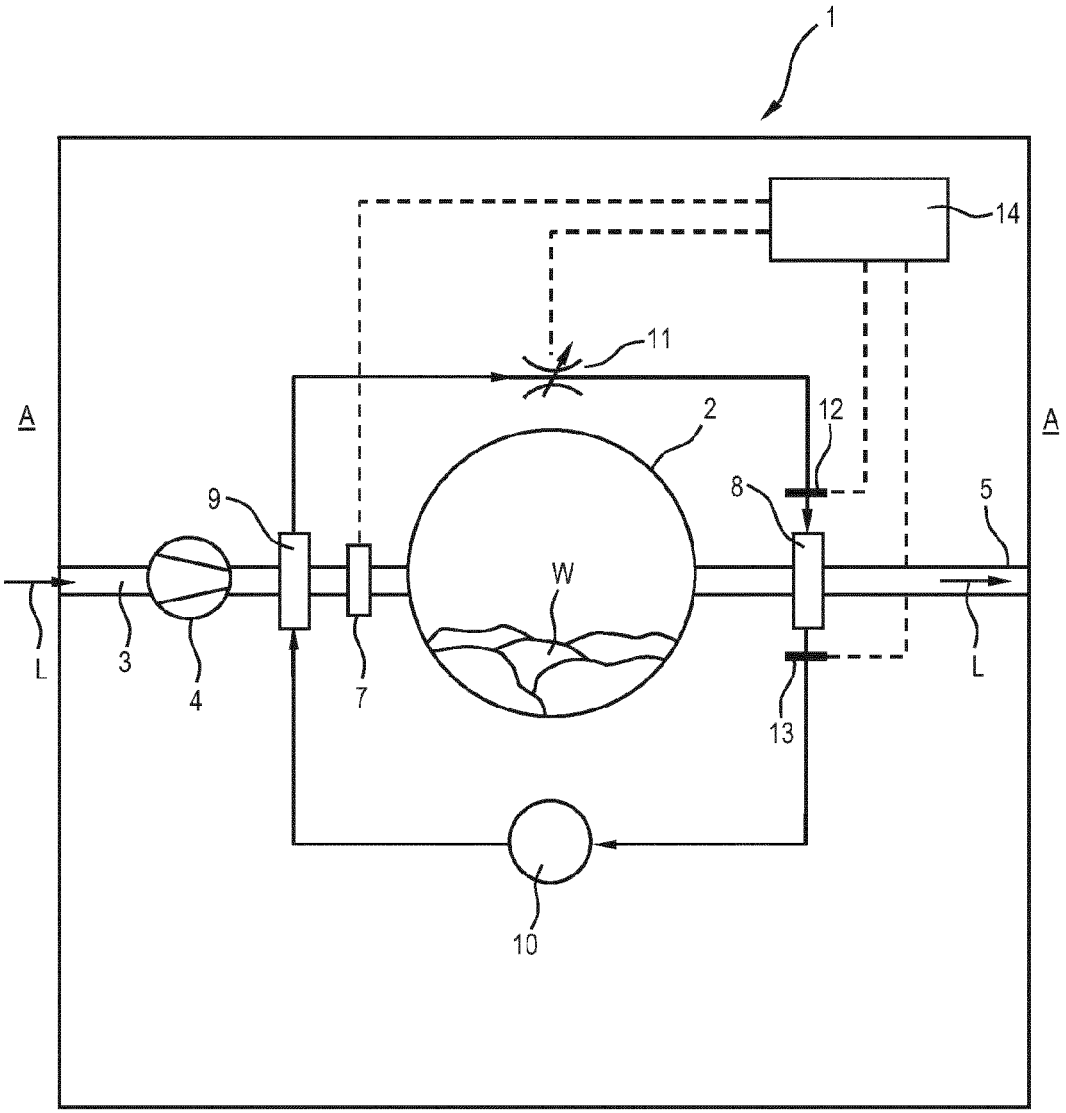
FIG. 1 shows a sketch of a vented laundry dryer according to a first embodiment.

FIG. 1 shows a sketch of a vented laundry dryer 1 according to a first embodiment. The vented laundry dryer 1 is a front loader with a rotatable laundry drum 2 as its laundry treatment compartment. An air inlet duct 3 passes from an outer compartment A to the laundry drum 2. On the air inlet duct 3 is a fan 4 for conveying air L (still in the form of fresh air at this point) from the outer compartment A into the laundry drum 2 and on (as exhaust air) from the laundry drum 2 by way of an air outlet duct 5 back into the outer compartment A. As it flows through the laundry drum 2 the air L absorbs moisture from laundry W contained therein, in order to dry the laundry W.

To heat the air L in the air inlet duct 3 in an energy-saving manner the vented laundry dryer 1 has a compression heat pump 8 to 11 with an evaporator 8, a condenser 9, a compressor 10 and a relaxation unit in the form of an expansion valve 11. The condenser 9 is thermally coupled to the air inlet duct 3 and the evaporator 8 is thermally coupled to the air outlet duct 5. This causes heat to be extracted from the air outlet duct 5 or the hot moist air (exhaust air) L present in the air outlet duct 5 and transferred to the evaporator 8. Conversely, because the condenser 9 is thermally coupled to the air inlet duct 3, heat can be transferred from the condenser 9 to the air inlet duct 3 or to the air (fresh air) L present in the air inlet duct 3. The temperatures or temperature differences at the evaporator 8 and condenser 9 allow the heat pump 8 to 11 to operate. A mode of operation of the heat pump 8 to 11 is well known in principle and does not have to be set out further here.

An additional heater 7 is also disposed on the air inlet duct 3 to heat the laundry W further and accelerate its drying. The fan 4 can alternatively be disposed on the air outlet duct 5.

The efficiency of the heat pump 8 to 11 is a function of these temperatures or temperature differences and can be optimized by design, for example by dimensioning the elements of the heat pump 8 to 11 for predetermined basic conditions. In order to be able to maintain a high level of efficiency even with changing basic conditions, in particular when operating the vented laundry dryer 1 optionally with and without the additional heater 7, a relaxation property of the expansion valve 11 can be set as a function of at least one parameter associated with an activity of the additional heater 7. To this end the expansion valve is configured as a (settable) expansion valve 11, the flow cross section of which can be set as a function of the at least one parameter.

Provided in the heat pump or cooling circuit of the heat pump 8 to 11 upstream and downstream of the evaporator 8 to set the expansion valve 11 are temperature sensors 12 and 13, which detect an entry temperature or exit temperature of the coolant at the evaporator 8. The temperature sensors 12 and 13 are coupled to a control facility 14 that also serves as an evaluation apparatus, as shown by the associated broken lines. The control facility 14 can also control for example the operation of other components (such as the laundry drum 2 and additional heater 7). The sensor signals or temperature values detected by the temperature sensors 12 and 13 are linked to a temperature difference in the control facility 14.

The control facility 14 therefore monitors the temperature difference and can set the flow cross section of the expansion valve 11 continuously as a function of the temperature difference, e.g. in proportion to the temperature difference. In particular the flow cross section may be enlarged as the temperature difference rises and reduced as the temperature difference drops. The flow cross section may also assume a smallest (although finite) value, if the temperature difference reaches or drops below a lower threshold value when the additional heater 7 is deactivated. Also the flow cross section may assume a greatest value, if the temperature difference reaches or exceeds an upper threshold value when the additional heater 7 is operated at maximum power. Setting the flow cross section adjusts the heat pump 8 to 11 to the operation of the vented laundry dryer 1 in a very accurate manner with and without the additional heater 7, even if the power of the additional heater 7 is variable.

Figure 2:
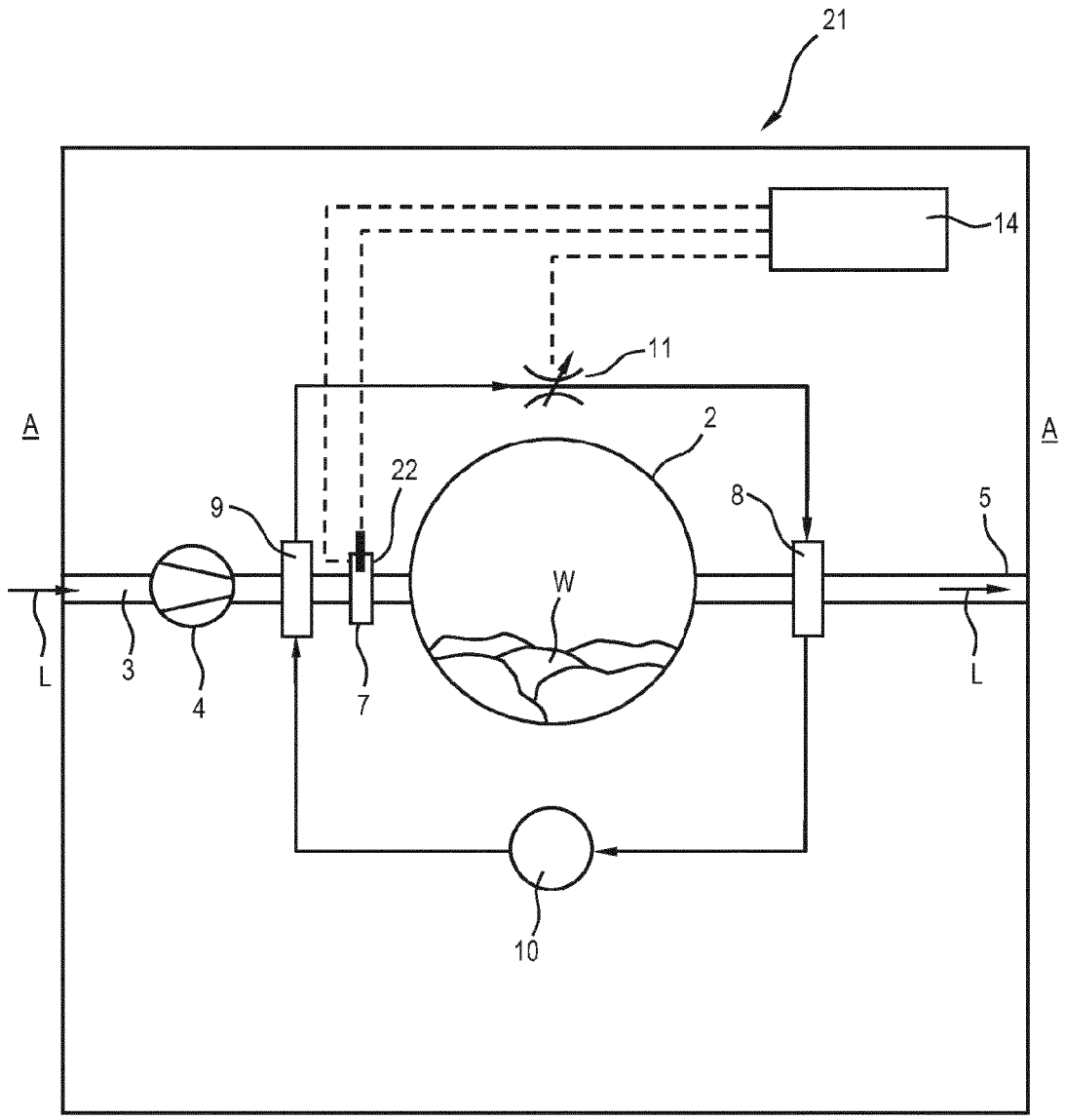
FIG. 2 shows a sketch of a vented laundry dryer according to a second embodiment.

FIG. 2 shows a sketch of a vented laundry dryer 21 according to a second embodiment. The vented laundry dryer 21 is configured in a similar manner to the vented laundry dryer 1 but now the flow cross section of the expansion valve 11 can be set as a function of a current heating power of the additional heater 7. The current heating power can be detected by means of a current sensor 22 or can be captured or calculated in another manner, for example indirectly. In particular the flow cross section of the expansion valve 11 can be enlarged as the heating power increases and reduced as the heating power drops.

Figure 3:
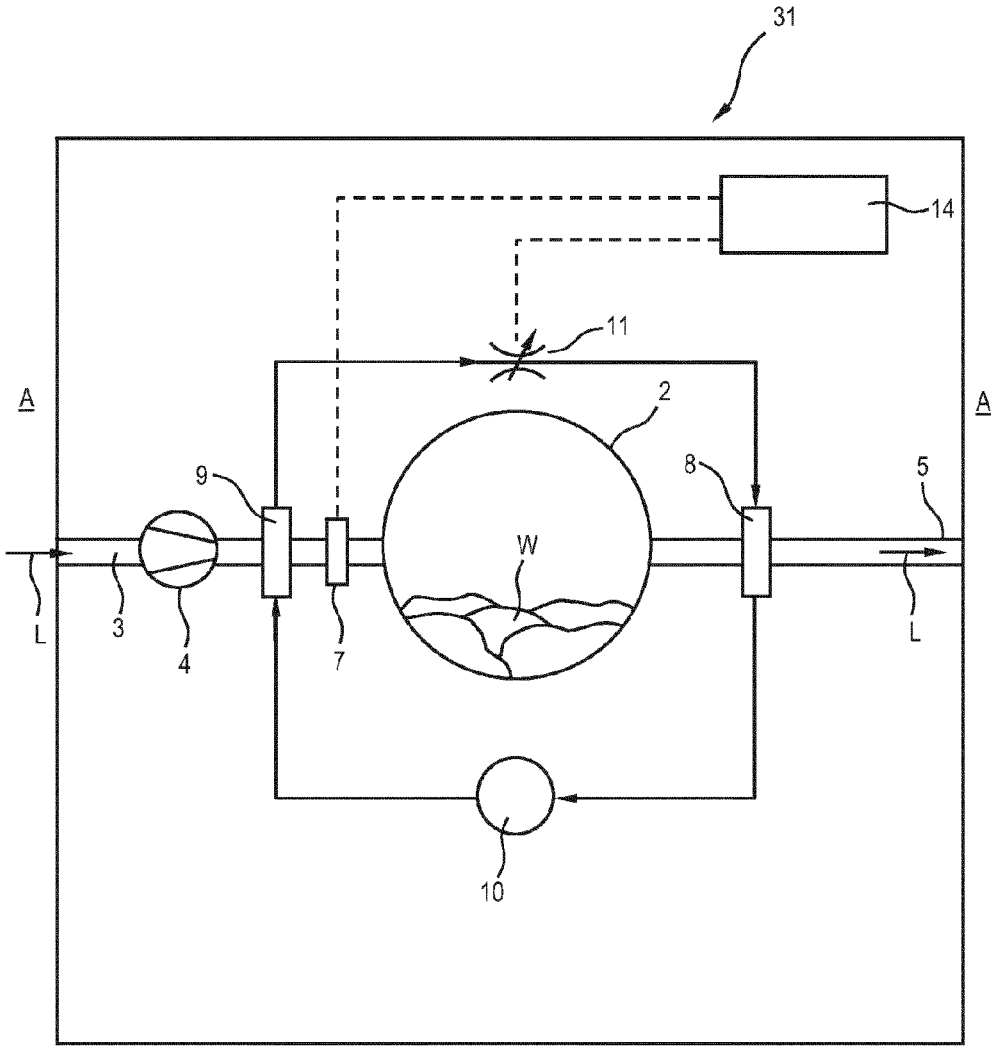
FIG. 3 shows a sketch of a vented laundry dryer according to a third embodiment.

FIG. 3 shows a sketch of a vented laundry dryer 31 according to a third embodiment. The vented laundry dryer 21 is configured in a similar manner to the vented laundry dryer 1 but now the flow diameter of the expansion valve 11 is reduced or narrowed to a smallest flow cross section when an additional heater 7 is deactivated (first operating position) and is enlarged or widened to a greatest flow cross section when an additional heater 7 is connected (second operating position). The vented laundry dryer 31 does not require a sensor system for this but may identify the activation state ("on" or "off") of the additional heater 7 for example by means of the control facility 14, e.g. by the use of certain flags or signal levels. This adjustment of the heat pump 8 to 11 can be applied particularly advantageously, if the additional heater 7 can only be switched on and off but its heating power cannot be set in a variable manner.

In another variant of a vented laundry dryer covered by FIG. 3 the flow diameter of the expansion valve 11 may be set (in particular in stages) as a function of a setpoint value (that can be changed in particular in stages) of the heating power of the additional heater 7. There is no need for a sensor system here either, as the setpoint value (in the present instance for example in the form of an absolute value or a relative value (e.g. as a heating stage) is already known and can be stored for example in the control facility 14.

Figure 4:
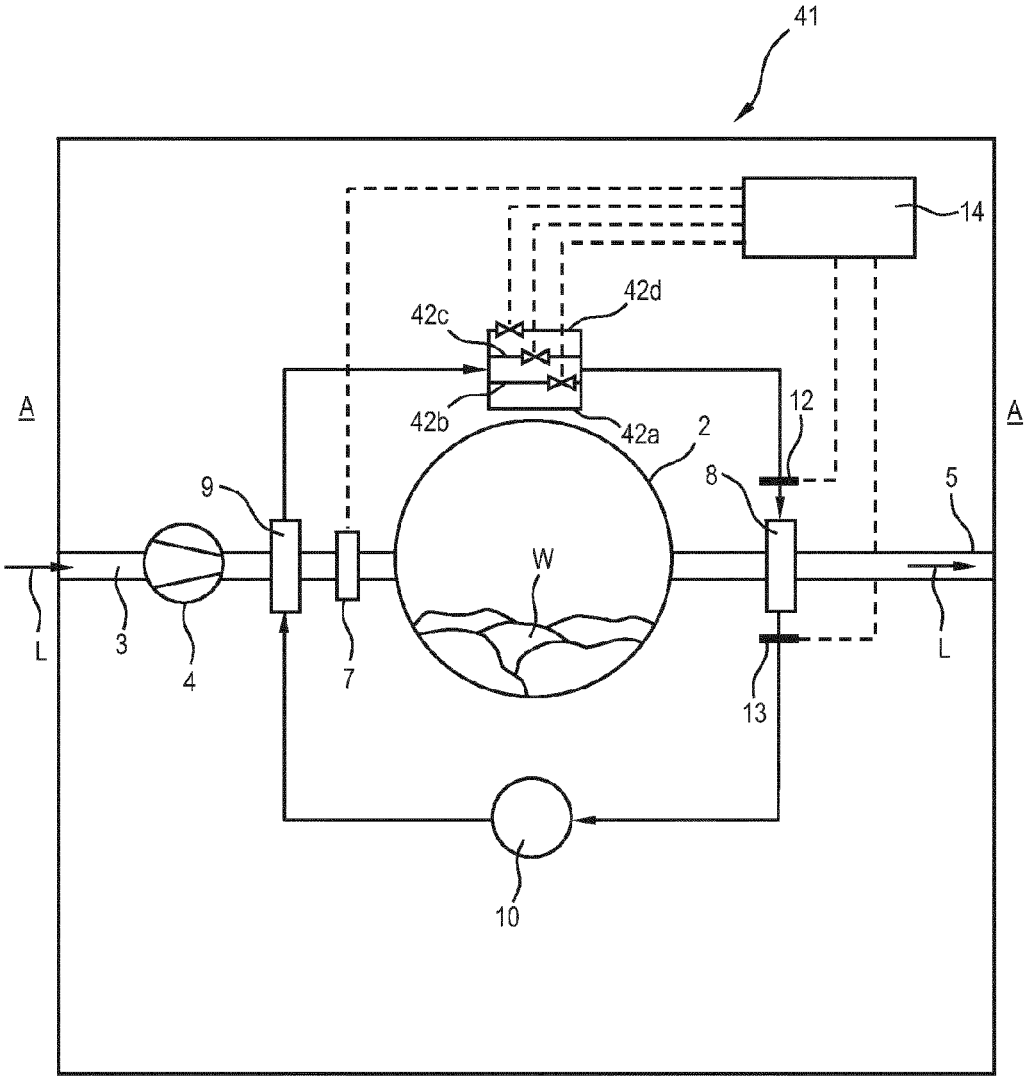
FIG. 4 shows a sketch of a vented laundry dryer according to a fourth embodiment.

FIG. 4 shows a sketch of a vented laundry dryer 41 according to a fourth embodiment. The vented laundry dryer 41 is similar in structure to the vented laundry dryer 1 but now has a relaxation unit in the form of a group of four capillaries 42*a-d* connected fluidically in a parallel manner, of which three capillaries 42*b-e* can be opened and closed optionally by means of the control facility 14. The capillary 42*a* in contrast has a fixed flow cross section. This allows the flow cross section of the relaxation unit 42*a-d* to be set in four stages here.

The vented laundry dryer 41 is also able to monitor the temperature difference at the evaporator 8 and to open at least one previously closed capillary 42*b-d* if the temperature difference rises and to close at least one previously opened capillary 42*b-d* if the temperature difference drops. In particular the temperature difference may reach or rise above or drop below an associated threshold value to open or close one of the capillaries 42*b-d*.

Of course the present invention is not limited to the illustrated exemplary embodiments.

The vented laundry dryer 41 may therefore also set the capillaries 42*a-d* as a function of a heating power setpoint value that can be set in stages, the number of possible setpoint values for the heating power (including zero for a deactivated additional heater 7) preferably corresponding to the number of capillaries 42*a-d*. A certain number of open capillaries can then be assigned to each setpoint value.

Features of different exemplary embodiments and variants can also be combined with one another or used as alternatives.

LIST OF REFERENCE CHARACTERS

1 Vented laundry dryer
2 Laundry drum
3 Air inlet duct
4 Fan
5 Air outlet duct
7 Additional heater
8 Evaporator
9 Condenser
10 Compressor
11 Expansion valve
12 Temperature sensor
13 Temperature sensor
14 Control facility
21 Vented laundry dryer
22 Current sensor
31 Vented laundry dryer
41 Vented laundry dryer
42*a-d* Capillaries
A Outer compartment
L Air
W Laundry

The invention claimed is:

1. A vented laundry dryer, the vented laundry dryer comprising:

an air inlet duct, which passes from the outside to a heatable laundry treatment compartment, an air outlet duct, which passes from the laundry treatment compartment to the outside, a heat recovery system for transferring heat from the air outlet duct to the air inlet duct and an additional heater disposed on the air inlet duct, wherein the heat recovery system is a heat pump with an evaporator, a condenser, a compressor and a relaxation unit, the condenser being thermally coupled to the air inlet duct and the evaporator being thermally coupled to the air outlet duct, and a relaxation property of the relaxation unit is set as a function of at least one parameter associated with an activity of the additional heater.

2. The vented laundry dryer as claimed in claim 1, wherein the relaxation property of the relaxation unit is set as a function of at least one operating parameter of the additional heater.

3. The vented laundry dryer as claimed in claim 2, wherein the relaxation property of the relaxation unit is set as a function of a current heating power of the additional heater.

4. The vented laundry dryer as claimed in claim 2, wherein the relaxation property of the relaxation unit is set as a function of an activation state of the additional heater.

5. The vented laundry dryer as claimed in claim 1, wherein the relaxation unit is an expansion valve and a flow cross section of the expansion valve is set as a function of the at least one parameter.

6. The vented laundry dryer as claimed in claim 1, wherein the relaxation unit has a group of capillaries connected fluidically in a parallel manner, of which at least one capillary is opened and closed as a function of the at least one parameter of the additional heater.

7. The vented laundry dryer as claimed in claim 1, wherein the relaxation unit is switched between a first operating position and a second operating position of the additional heater.

8. The vented laundry dryer as claimed in claim 1, wherein the relaxation unit is set in multiple stages or continuously.

9. The vented laundry dryer as claimed in claim 1, wherein the relaxation property of the relaxation unit is set as a function of a temperature difference and/or a pressure difference.

10. The vented laundry dryer as claimed in claim 9, wherein the relaxation property of the relaxation unit is set as a function of a temperature difference and/or a pressure at the evaporator.

11. A method for operating the vented laundry dryer as claimed in claim 1, the method comprising:

(a) monitoring at least one parameter associated with an activity of the additional heater, and (b) changing a relaxation property of the relaxation unit as a function of the at least one parameter.

12. The method as claimed in claim 11, wherein the relaxation unit is an expansion valve, the method further comprising:

(a) monitoring an activation state of the additional heater, and (b) widening a flow diameter of the expansion valve with the additional heater connected and narrowing the flow diameter of the expansion valve with the additional heater deactivated.

13. The method as claimed in claim 11, wherein the relaxation unit is an expansion valve, the method further comprising:

(a) monitoring a temperature difference and/or a pressure difference, (b) widening a flow diameter of the expansion valve as the temperature difference and/or pressure difference rises, and (c) reducing the flow diameter of the expansion valve as the temperature difference and/or pressure difference drops.

14. The method as claimed in claim 13, wherein the temperature difference and/or a pressure difference is monitored at the evaporator.

15. The method as claimed in claim 11, wherein the relaxation unit has a group of capillaries connected fluidically in a parallel manner, of which at least one capillary is opened and closed optionally as a function of the at least one parameter, the method further comprising:

(a) monitoring a heating power of the additional heater, (b) opening at least one previously closed capillary as the heating power rises, and (c) closing at least one previously opened capillary as the heating power drops.

16. The method as claimed in claim 11, wherein the relaxation unit has a group of capillaries connected fluidically in a parallel manner, of which at least one capillary is opened and closed optionally as a function of the at least one parameter, the method further comprising:

(a) monitoring a temperature difference and/or a pressure difference, (b) opening at least one previously closed capillary as the temperature difference and/or pressure difference rises, and (c) closing at least one previously opened capillary as the temperature difference and/or pressure difference drops.

17. The method as claimed in claim 16, wherein the temperature difference and/or a pressure difference is monitored at the evaporator.

18. The method as claimed in claim 11, wherein the at least one parameter is an operating parameter.

* * * * *